US005440909A

United States Patent [19]

Ely et al.

[11] Patent Number: 5,440,909

[45] Date of Patent: Aug. 15, 1995

[54] LOCK AND KEY SHELL ASSEMBLY

[75] Inventors: Timothy B. Ely; Frederick P. Finck, both of Fairfield, Conn.

[73] Assignee: The Highfield Mfg. Company, Bridgeport, Conn.

[21] Appl. No.: 84,416

[22] Filed: Jun. 29, 1993

[51] Int. Cl.[6] ..... E05B 19/00

[52] U.S. Cl. ..... 70/395; 70/408; 70/397

[58] Field of Search ..... 70/366, 395, 397, 408, 70/444, 445

[56] References Cited

U.S. PATENT DOCUMENTS

| | | | |
|---|---|---|---|
| 14,059 | 1/1856 | Harrison | 70/395 X |
| 646,621 | 4/1900 | Denman | 70/395 |
| 1,237,115 | 8/1917 | Stein | 70/395 |
| 2,177,996 | 10/1939 | Raymond | 70/386 |
| 3,213,653 | 10/1965 | Probasco | 70/166 |
| 3,630,053 | 12/1971 | Krakauer | 70/408 X |
| 4,018,069 | 4/1977 | Lipschutz | 70/395 |
| 4,366,688 | 1/1983 | Bennett | 70/395 |
| 4,492,100 | 1/1985 | Swisher | 70/395 X |
| 4,516,000 | 5/1985 | Ryberg et al. | 70/408 X |
| 4,766,749 | 8/1988 | Sperber | 70/491 |
| 4,836,001 | 6/1989 | Foshee | 70/368 |
| 4,838,061 | 6/1989 | Tai-Seng | 70/395 X |
| 4,910,983 | 3/1990 | Taylor | 70/408 X |
| 5,086,631 | 2/1992 | Agbay | 70/366 |
| 5,121,618 | 6/1992 | Scott | 70/367 |

FOREIGN PATENT DOCUMENTS 4101461 8/1991 Germany ..... 70/408

OTHER PUBLICATIONS

"The Agbay Lock Key"—brochure by Inner-Tite Corp. Published prior to May 5, 1993.

*Primary Examiner*—Peter M. Cuomo
*Assistant Examiner*—Suzanne L. Dino
*Attorney, Agent, or Firm*—Lorusso & Loud

[57] ABSTRACT

There is disclosed a lock and key assembly comprising a lock assembly including a lock body having cylindrical portions, a cylinder retained in the lock body and mounted for rotative movement in the lock body, the cylinder having a head portion having a keyway therein, and a shank portion extending from the head portion and adapted to activate a lock mechanism upon rotation of the shank portion, and a key shell assembly comprising a tubular grip portion, a piston disposed in the grip portion, a key extending from the piston and adapted to enter the keyway, the piston being rotatably movable in the grip portion to turn the key in the keyway and thereby turn the cylinder to cause activation of the lock mechanism, the key shell assembly grip portion being engageable with the lock assembly lock body to hold the lock body against rotative movement during the rotative movement of the cylinder.

16 Claims, 6 Drawing Sheets

LOCK AND KEY SHELL ASSEMBLY

BACKGROUND OF THE INVENTION

1. Field of the Invention

This invention relates to locking assemblies and is directed more particularly to a cylinder-type lock assembly and a key shell assembly for use therewith, the key shell assembly being operable to prevent rotation of a body portion of the lock assembly upon turning of the cylinder portion of the lock assembly in the body portion.

2. Description of the Prior Art

As will be discussed in detail hereinbelow, it is known to provide a lock assembly including a tubular lock body and disposed therein a cylinder adapted to be turned by a key inserted in a key way in the cylinder. In correct operation, the cylinder turns through a limited arc in the lock body to activate a lock mechanism and the lock body remains stationary. It is sometimes the case that the lock body is loosely mounted in its base member and, upon turning of the cylinder, there is concurrent turning of the lock body, such that no relative turning takes place between the cylinder and the lock body and the lock assembly fails to function.

Accordingly, there is a need for a key assembly which operates to hold the lock body stationary while the cylinder is rotated within the body.

SUMMARY OF THE INVENTION

An object of the invention is, therefore, to provide a lock and key assembly wherein the key assembly is operative to engage a lock body portion of a lock assembly and retain the body portion against rotative movement, while the key is manipulable to rotate a lock cylinder portion within the lock body portion to effect relative rotative movement therebetween, to effect activation of a lock mechanism.

With the above and other objects in view, as will hereinafter appear, a feature of the present invention is the provision of a lock and key shell assembly comprising a lock assembly for securing a first member to a second member, the lock assembly comprising a lock body having a first cylindrical portion for disposal in a first bore in the first member and a first bore in the second member, a second cylindrical portion for disposal in a second bore in the second member, the second cylindrical portion having a larger diameter than the first cylindrical portion and having an exposed annular surface, an annular collar portion extending outwardly from the first cylindrical portion and forming an end of the second cylindrical portion, a cylinder mounted for rotative movement in the lock body, the cylinder having a head portion disposed in the lock body second cylindrical portion and having a keyway therein and a shank portion extending from the head portion and disposed in the lock body first cylindrical portion, movable members mounted in openings in the first cylindrical portion and adapted to enter recesses in the first member to lock the lock assembly first cylindrical portion to the first member, the shank portion being configured to cause movement of the movable members into the first member recesses and to permit movement of the movable members out of the first member recesses upon rotation of the shank portion, and a key shell assembly comprising a tubular grip portion having an annular edge, a piston disposed in the grip portion, a key extending from the piston and adapted to enter the keyway, the piston being rotatably movable in the grip portion to turn the key in the keyway and thereby turn the cylinder to cause movement of the movable members in the recesses, the key shell assembly grip portion annular surface being engageable with the lock assembly lock body exposed annular surface to hold the lock body against rotative movement during the rotative movement of the cylinder.

The above and other features of the invention, including various novel details of construction and combination of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENT

Figure 1:
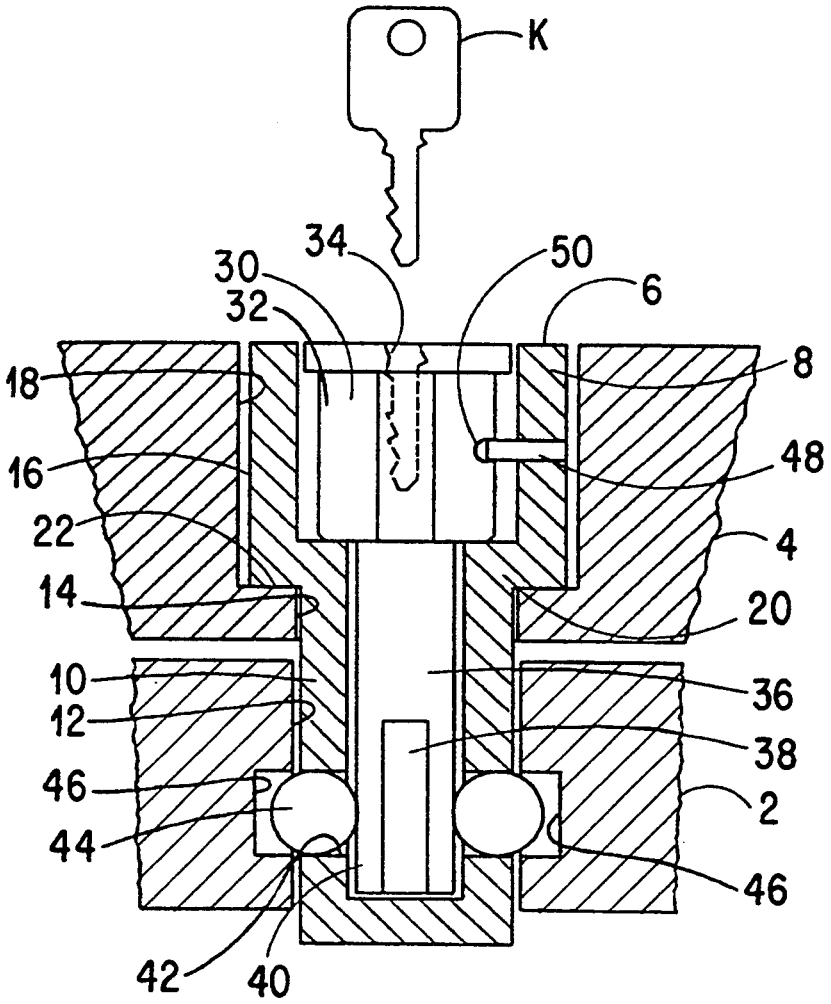
PRIOR ART FIG. 1
FIG. 1 is an elevational, partly sectional, view of a prior art lock and key assembly.

Referring to FIG. 1, it will be seen that in a known lock and key assembly for locking together first and second members 2 and 4, the lock assembly 6 includes a lock body 8. The lock body 8 is provided with a first cylindrical portion 10 adapted to be disposed in a first bore 12 in the first member 2 and a first bore 14 in the second member 4. The lock body 8 is further provided with a second cylindrical portion 16 adapted to be disposed in a second bore 18 in the second member 4. The first and second members first bores 12, 14 are substantially equal in diameter. The diameter of the second bore 18 is larger than the diameters of the first bores 12, 14.

An annular collar portion 20 extends radially outwardly from the first cylindrical portion 10 and forms an end of the second cylindrical portion 16. A shelf 22 in the second bore 18 receives the collar portion 20 of the second cylindrical portion 16 and is in abutting engagement therewith.

Still referring to FIG. 1, the lock and key assembly includes a cylinder 30 mounted for rotative movement in the lock body 8. The cylinder 30 is provided with a head portion 32 disposed in the lock body second cylindrical portion 16 and having a keyway 34 therein adapted to receive a key K, and a shank portion 36 integral with, and extending from, the head portion 32.

The lock mechanism of the lock assembly 6 includes the provision in the shank portion 36 of the cylinder 30 near its distal end, of flat portions 38 and rounded portions 40. The lock body first cylindrical portion 10 is provided with openings 42 in which are disposed balls 44. The openings 42 are aligned with recesses 46 in the first member 2. The rounded portions 40 of the cylinder shank portion 36, when engaged with the balls 44, force the balls 44 in part into the first member recesses 46, preventing the withdrawal of the lock assembly from the first member first bore 12, thereby preventing separation of the first and second members 2,4. Upon turning Of the cylinder 30, such that the shank flat portions 38 abut the balls 44, the balls are accommodated by the openings 42, permitting withdrawal of the lock body 8 and cylinder 30 from the first member 2, and thereby permitting separation of the first and second members 2,4.

A pin 48, or other protuberance, extends inwardly from the lock body second cylindrical portion 16, with a distal end thereof disposed in a closed end groove 50 in a side wall of the cylinder 30. The closed end groove 50 serves to limit movement of the groove about the pin 48 and thereby limit rotational movement of the cylinder 30 in the lock body 8.

Figure 2:
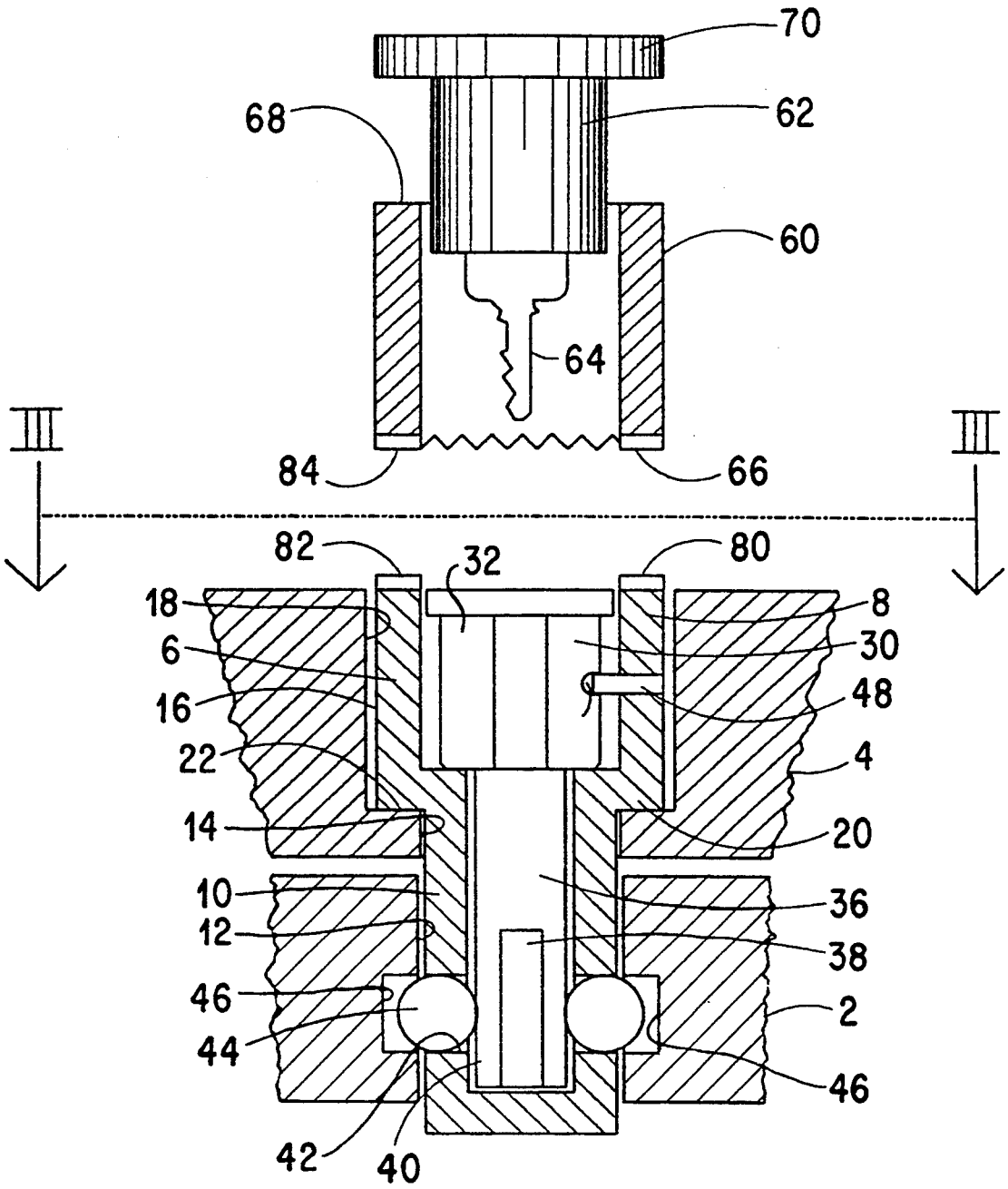
FIG. 2 is an elevational, partly sectional, view of one form of a lock and key shell assembly illustrative of an embodiment of the invention.
Figure 3:
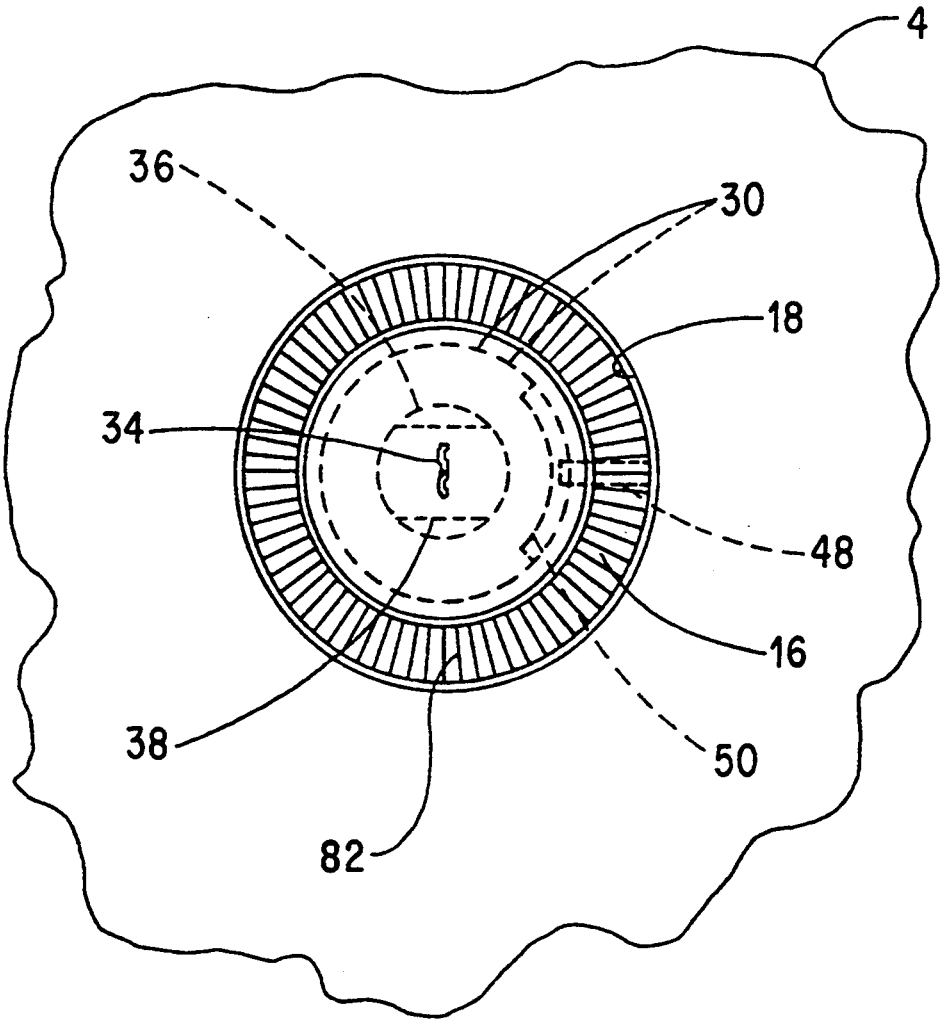
FIG. 3 is a top plan view of the lock assembly, taken along line III—III of FIG. 2.

Turning to FIGS. 2 and 3, it will be seen that the lock and key assembly of the present invention includes a key shell assembly comprising tubular grip portion 60, a piston 62 slidably disposed in the grip portion, and a key shank 64 extending from one end of the piston 62 and adapted to enter the keyway 34. The grip portion is provided with first and second edges 66,68. The piston 62 is slidably movable axially in the grip portion 60 to move the key shank 64 into and out of engagement with the keyway 34, and is movable rotatively in the grip portion 60 to effect turning of the key shank 64. The piston 62 may be provided with a cap portion 70 adapted to engage the grip portion second edge 68 to limit axial movement of the piston 62 in the grip portion 60.

Still referring to FIGS. 2 and 3, it will be seen that the lock body second cylindrical portion 16, on an upper annular edge 80 thereof, is provided with a toothed surface 82 which is complementary to a toothed surface 84 on the grip portion first edge 66. The complementary surfaces 82, 84 need not be "toothed" in a literal sense, but do have surfaces which are interlocking, such that the lock body 8 is held against turning movement relative to the key assembly grip portion 60.

The key shank 64 is shown in FIG. 2 as a shank portion of an ordinary tumbler-type padlock key or door key, similar to the key K shown in FIG. 1, but the key shank 64 may, in practice, be a generally cylindrical shank with appropriate cam surfaces formed therein, or other such extension capable of entering a keyway and activating a lock in which the keyway is disposed.

Figure 4:
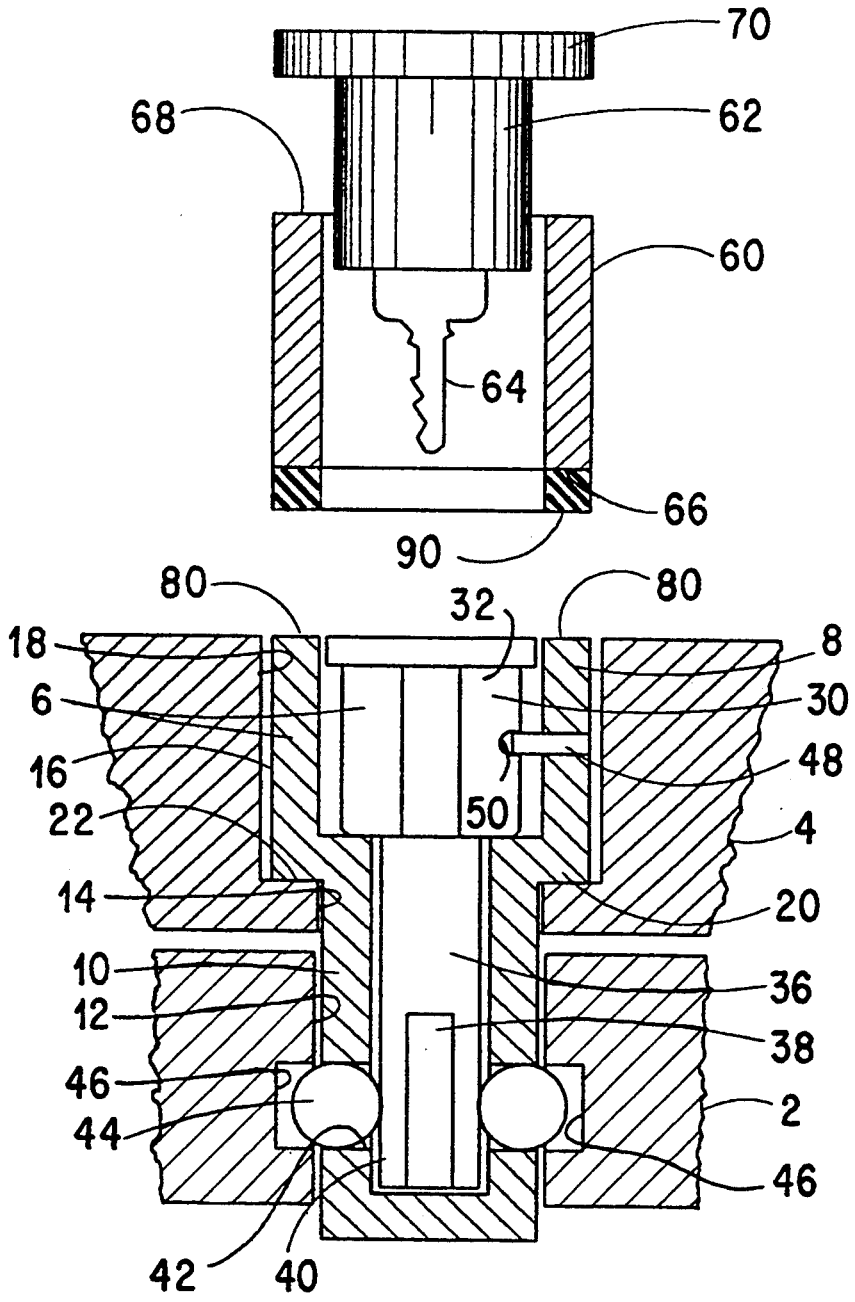
FIG. 4 is an elevational, partly sectional, view of another form of lock and key shell assembly illustrative of an alternative embodiment of the invention.

In FIG. 4, there is shown an alternative embodiment in which the lock body second cylindrical portion upper annular edge 80 remains substantially planar and the first edge 66 of the key shell tubular grip portion 60 has fixed thereto a friction ring 90, of rubber or the like, adapted to engage the lock body edge 80. The friction ring 90 may be a complete ring or, alternatively, segments thereof. The annular edge 80 may be roughened, stepped, or otherwise configured to provide additional frictional properties.

Figure 5:
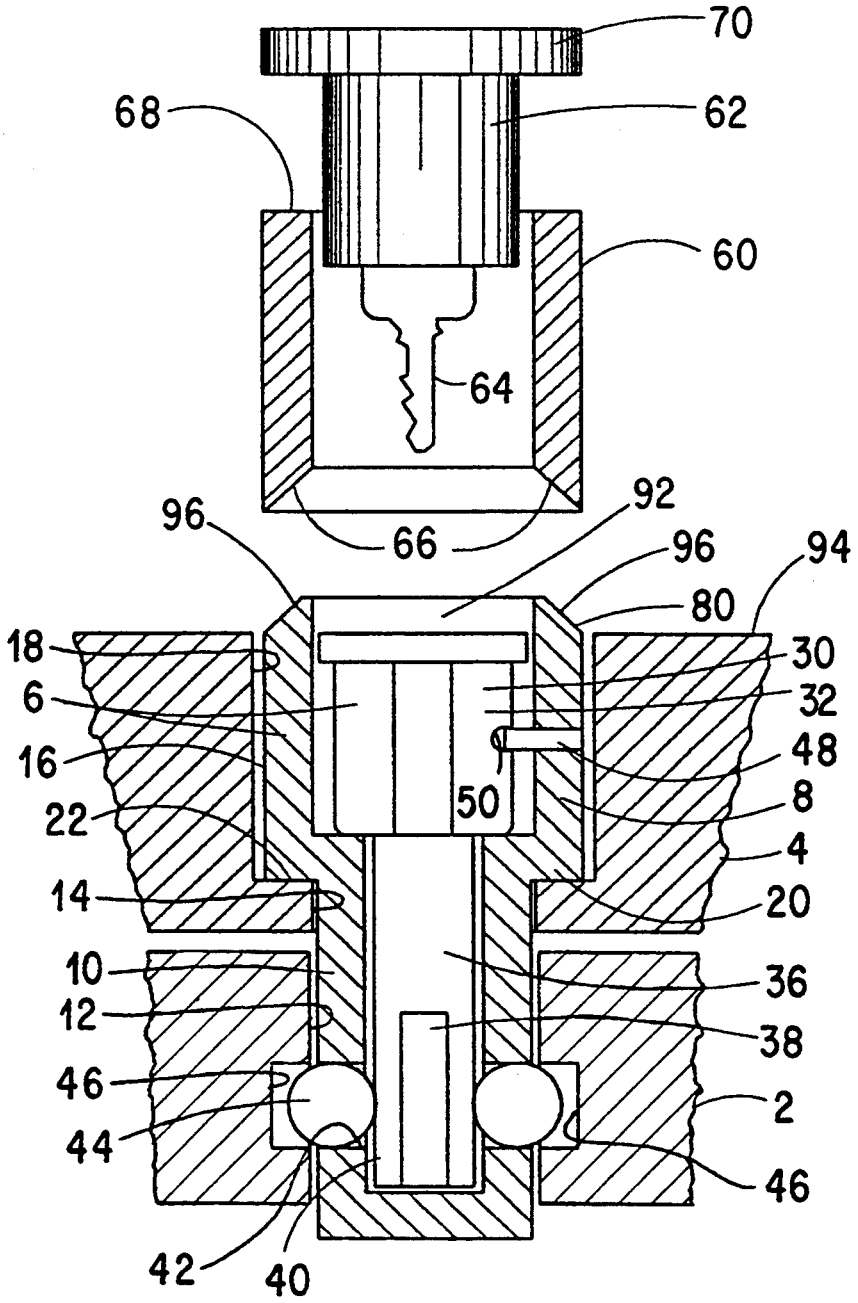
FIG. 5 is an elevational, partly sectional, view of another form of lock and key shell assembly illustrative of another alternative embodiment of the invention.

In FIG. 5, there is shown another alternative embodiment in which the lock body second cylindrical portion 16 is provided with an extended wall portion 92 which extends beyond a surface 94 of the second member 4. In this embodiment, the lock body edge 80 comprises a generally frusto-conical surface 96. The tubular grip portion first edge 66 is configured complementarily to the surface 96 and adapted to engage the surface 96. Again, the frusto-conical surfaces 66, 96 may be textured or otherwise configured to increase frictional properties.

Figure 6:
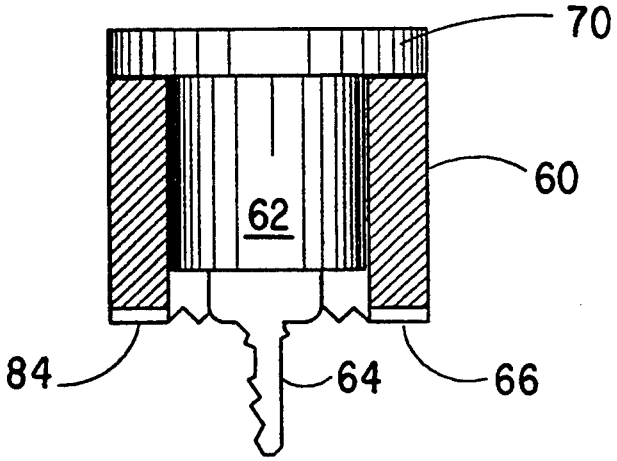
FIG. 6 is an elevational, partly sectional, view of still another form of key shell assembly illustrative of another alternative embodiment of the invention.

In FIG. 6, there is shown another alternative embodiment in which the piston 62 is axially fixed in the grip portion 60, but rotatably moveable therein. The first edge 66 of the grip portion 60 may be of the type shown in any of FIGS. 2–5. In the FIG. 6 embodiment, the piston 62 is stationary axially of the grip portion 60 and is not axially moveable therein, contrary to the other embodiments illustrated.

In operation, an operator grasps the tubular grip portion 60 with the piston 62 therein. The first edge 66 of the grip portion 60 is brought to bear against the lock body edge 80. In the embodiment shown in FIGS. 2 and 3, the key shell toothed surface 84 is brought into engagement with the lock body toothed surface 82. In the embodiment shown in FIG. 4, the friction ring 90 is brought into engagement with the lock body edge 80. In the embodiment shown in FIG. 5, the key shell frusto-conically shaped surface 66 is brought into engagement with the lock body frusto-conically shaped surface 96.

In the embodiments shown in FIGS. 2–5, the operator then pushes the piston 62 axially into the grip portion 60, causing the key shank 64 to enter the keyway 34. In the embodiment shown in FIG. 6, the key shank 64 enters the keyway 34 as the edges 66, 80 are brought together. The operator, using the cap portion 70, turns the piston 62 in the grip portion 60, causing the key shank 64 to activate the lock mechanism. In the illustrated embodiments, the engagement of the grip portion with the lock body serves to hold the lock body against rotation while the key shank 64, and thereby the cylinder 30, is turned.

It is to be understood that the present invention is by no means limited to the particular constructions herein disclosed and/or shown in the drawings, but also comprises any modifications or equivalents within the scope of the claims.

Having thus described our invention, what we claim as new and desire to secure by Letters Patent of the United States is:

1. A lock and key shell assembly comprising a lock assembly for securing a first member to a second member, said lock assembly comprising a cylindrical lock body portion for disposal in bores in said members, said lock body having an exposed annular surface, a cylinder retained in and mounted for rotative movement in said lock body, said cylinder having a head portion having a keyway therein, and a shank portion operative upon turning to activate a lock mechanism, and a key shell assembly comprising a tubular grip portion comprising a one-piece cylindrically-shaped tube having an annular surface, a cylindrically-shaped piston slidably disposed in said grip portion, the sidewall of said piston being substantially entirely slidable along the interior of said grip portion, a key extending from only one end of said piston, said key extending from said one end being adapted to enter said keyway, said piston being mounted in said grip portion so as to be always rotatable to turn said key in said keyway and thereby turn said cylinder in said lock body to cause activation of said lock mechanism, said key shell assembly grip portion annular surface being interlockingly engageable with said lock assembly lock body exposed annular surface to hold said lock body against rotative movement relative to said grip portion during said rotative movement of said cylinder.

2. The lock and key shell assembly in accordance with claim 1 wherein said lock body exposed annular surface and said grip portion annular surface are toothed surfaces for interengaging with each other.

3. The lock and key shell assembly in accordance with claim 1 wherein said grip portion annular surface comprises friction ring means fixed to said grip portion for engagement with said lock body exposed annular surface.

4. The lock and key shell assembly in accordance with claim 3 wherein said friction ring is of elastomeric material.

5. The lock and key shell assembly in accordance with claim 1 wherein said lock body exposed annular surface and said grip portion annular surface are complementary substantially frusto-conically shaped surfaces.

6. The lock and key shell assembly in accordance with claim 1 wherein said piston is slidably movable axially in said grip portion, said key is adapted to enter said keyway upon axial sliding movement of said piston in said grip portion, said grip portion is provided with a second annular surface, and said piston includes a cap portion, said cap portion being engageable with said second annular surface to limit axial movement of said piston in said grip portion.

7. The lock and key assembly in accordance with claim 6 wherein said piston cap portion extends beyond the periphery of said piston and is engageable with said second annular surface of said tubular grip portion of said key shell assembly to limit axial movement of said piston in said grip portion.

8. The lock and key shell assembly in accordance with claim 1 wherein said grip portion is provided with a second annular surface and said piston includes a cap portion, said cap portion being engaged with said second annular surface and being slidably movable thereon as said piston is rotated.

9. A lock and key shell assembly comprising a lock assembly for securing a first member to a second member, said lock assembly comprising a lock body having a first cylindrical portion for disposal in a first bore in said first member and a first bore in said second member, a second cylindrical portion for disposal in a second bore in said second member, said second cylindrical portion having a larger diameter than said first cylindrical portion, and having an exposed annular surface, an annular collar portion extending outwardly from said first cylindrical portion and forming an end of said second cylindrical portion, a cylinder retained in and mounted for rotative movement in said lock body, said cylinder having a head portion disposed in said lock body second cylindrical portion and having a keyway therein, and a shank portion extending from said head portion and disposed in said lock body first cylindrical portion, movable members mounted in openings in said first cylindrical portion and adapted to enter recesses in said first member to lock said lock assembly first cylindrical portion to said first member, said shank portion being configured to cause movement of said movable members into said first member recesses and to permit movement of said movable members out of said first member recesses upon rotation of said shank portion, and a key shell assembly comprising a tubular grip portion comprising a one-piece cylindrically-shaped tube having a first annular surface, a cylindrically-shaped piston slidably disposed in said grip portion, the sidewalls of said piston being substantially entirely slidable along the interior of said grip portion, a key extending from only one end of said piston, said key extending from said one end being adapted to enter said keyway, said piston being mounted in said grip portion so as to be always rotatable to turn said key in said keyway and thereby turn said cylinder in said lock body to cause movement of said movable members in said recesses, said key shell assembly grip portion first annular surface being interlockingly engageable with said lock assembly lock body exposed annular surface to hold said lock body against rotative movement during said rotative movement of said cylinder.

10. The lock and key shell assembly in accordance with claim 9 wherein said means for interlocking said surfaces comprise tooth means.

11. The lock and key shell assembly in accordance with claim 9 wherein said grip portion annular surface comprises friction ring means fixed to said grip portion for engagement with said lock body exposed annular surface.

12. The lock and key shell assembly in accordance with claim 11 wherein said friction ring means comprises segments of a friction ring.

13. The lock and key shell assembly in accordance with claim 11 wherein said friction ring means is of elastomeric material.

14. The lock and key shell assembly in accordance with claim 12 wherein said friction ring means is of elastomeric material.

15. The lock and key shell assembly in accordance with claim 9 wherein said piston is slidably movable axially in said grip portion, and said key is adapted to enter said keyway upon axial sliding movement of said piston in said grip portion.

16. The lock and key shell assembly in accordance with claim 9 wherein said cylinder second cylindrical portion in said second member second bore upstands from a surface of said second member and has thereon said exposed annular surface, said exposed annular surface being of a substantially frusto-conical configuration, and wherein said key shell assembly grip portion annular surface is of a configuration complementary to said second cylindrical portion annular surface and is engageable therewith.

* * * * *